US007717265B2

(12) United States Patent
Honkawa et al.

(10) Patent No.: US 7,717,265 B2
(45) Date of Patent: May 18, 2010

(54) DEVICE FOR STORAGE, SHIPMENT AND DISPLAY OF MERCHANDISE

(75) Inventors: Bryan Honkawa, Malibu, CA (US); Lynda Resnick, Beverly Hills, CA (US)

(73) Assignee: POMWonderful, LLC, Los Angeles, CA (US)

( * ) Notice: Subject to any disclaimer, the term of this patent is extended or adjusted under 35 U.S.C. 154(b) by 1166 days.

(21) Appl. No.: 11/195,368

(22) Filed: Aug. 1, 2005

(65) Prior Publication Data

US 2007/0023319 A1 Feb. 1, 2007

(51) Int. Cl.
*B65D 19/20* (2006.01)

(52) U.S. Cl. ..... 206/386; 206/600; 206/736; 206/730

(58) Field of Classification Search ..... 206/229, 206/558, 599, 600, 730, 736, 767, 745, 774, 206/768, 499, 386, 597, 596, 45.28, 394, 206/740, 232, 735, 762, 734; 211/59.3, 71.01, 211/85.17, 149, 133.4, 196.2, 132.1, 126.16, 211/73; 108/115, 162, 54.3, 56.1; 312/117, 312/118, 119, 126, 184, 204, 260, 261, 265.2, 312/265.6, 282, 286
See application file for complete search history.

(56) References Cited

U.S. PATENT DOCUMENTS 1,904,760 A * 4/1933 Matheson ..... 312/42
2,712,487 A 7/1955 Miller
2,864,545 A 12/1958 Royce
3,314,531 A * 4/1967 Cheris et al. ..... 206/758
3,343,659 A * 9/1967 Marondel ..... 206/772
3,850,363 A 11/1974 Jacobs
3,918,576 A 11/1975 Taub
4,191,288 A 3/1980 Hostad
4,363,405 A * 12/1982 Christie ..... 206/774
4,565,316 A * 1/1986 Jes ..... 229/122
4,705,162 A * 11/1987 Kupersmit ..... 206/745
4,809,847 A * 3/1989 Schneider ..... 206/45.28
4,877,137 A * 10/1989 Govang et al. ..... 206/597
5,251,753 A * 10/1993 Pigott et al. ..... 206/766
5,370,233 A * 12/1994 Schutz et al. ..... 206/597
5,660,404 A * 8/1997 Dilley ..... 280/47.32
5,704,488 A * 1/1998 Smith ..... 206/598
5,794,782 A 8/1998 Ascik
5,865,316 A * 2/1999 Smith ..... 206/775
5,896,995 A * 4/1999 Murray et al. ..... 206/736
5,918,744 A * 7/1999 Bringard et al. ..... 206/596

(Continued)

OTHER PUBLICATIONS

Phorographs of an octagonal-shaped bin which was distributed in the United States before 2002.

(Continued)

*Primary Examiner*—J. Gregory Pickett
*Assistant Examiner*—Ernesto A Grano
(74) *Attorney, Agent, or Firm*—Jeffer Mangels Butler & Marmaro LLP

(57) ABSTRACT

A device for the storage, shipment and display of merchandise is provided. The device comprises a display bin and a frame disposed under the display bin. The frame comprises top and bottom supports and a cavity between the top and bottom supports. At least one storage bin disposed in the cavity of the frame and a sleeve comprising walls is disposed around at least a portion of the frame.

24 Claims, 9 Drawing Sheets

U.S. PATENT DOCUMENTS

| | | | | |
|---|---|---|---|---|
| 5,938,036 | A | 8/1999 | Villemure | |
| 6,267,255 | B1 * | 7/2001 | Brush | 211/59.4 |
| 6,454,107 | B1 * | 9/2002 | Belanger et al. | 211/59.3 |
| 6,547,084 | B2 * | 4/2003 | Bauman et al. | 211/71.01 |
| 6,557,708 | B2 | 5/2003 | Polacco | |
| 7,066,342 | B2 * | 6/2006 | Baechle et al. | 211/191 |
| 7,213,707 | B2 * | 5/2007 | Hubbs et al. | 206/443 |
| 2003/0150771 | A1 | 8/2003 | Mason et al. | |

OTHER PUBLICATIONS

Photographs of a 10 case bin on sale in the United States by applicant prior to the filing date of the present application (2002).
Photographs of a 10 case bin on sale in the United States by applicant prior to the filing date of the present application (2003).

* cited by examiner

DEVICE FOR STORAGE, SHIPMENT AND DISPLAY OF MERCHANDISE

FIELD OF THE INVENTION

The present invention relates generally to merchandise display stands and more particularly, to transportable merchandise display stands which are pre-packed with merchandise prior to shipment.

BACKGROUND OF THE INVENTION

It is often desirable for a manufacturer or supplier to provide retailers with a separate display stand, customized to display and promote its merchandise to retail customers. This is particularly true for bulk merchandise such as fruits and vegetables, which are typically stacked by the retailer, often indistinctly, on existing counters in the produce section of the grocery aisle.

Significant drawbacks exist, however, to providing separate displays stands for merchandise. For example, the costs associated with shipping both merchandise and a separate display stand are often significant, particularly in cases where the merchandise is perishable. This is because shipment costs are typically determined by factors such as the weight and dimensions of the products shipped and, in the case of perishable items, refrigeration and shipment deadlines.

To reduce costs associated with shipment, unassembled promotional display stands may be provided to the retailers. After assembling the promotional display stand, merchandise may be stacked or otherwise arranged on the display stand. This, however, suffers the disadvantage in requiring complete assembly and stocking of the promotional display at the retail site, a task which is often complicated and time-consuming.

Accordingly, a need exists for ready-made display stand, which is both cost and labor efficient, to promote merchandise at the point-of-sale location.

BRIEF SUMMARY OF THE PREFERRED EMBODIMENTS

In accordance with a first aspect of the present invention, a device for the storage, shipment and display of merchandise is provided. The device comprises a display bin and a frame disposed under the display bin. The frame comprises a top support coupled to a bottom support and a cavity between the top and bottom supports. At least one storage bin is disposed in the cavity of the frame. A sleeve comprising walls is disposed around at least a portion of the frame.

In a preferred embodiment, the display and storage bins contain merchandise. In another preferred embodiment, the device further comprises a lid to cover the merchandise in the display bin and the lid preferably comprises apertures to permit air flow through the lid.

In another preferred embodiment, the device further comprises one or more pallets disposed under the frame to permit transport of the device by a forklift or other mechanical device for transporting merchandise. In one preferred embodiment, the pallets are formed in the bottom support of the frame. In another preferred embodiment, the pallets are separate from the bottom support of the frame. In this preferred embodiment, pallets are removably disposed under the bottom support of the frame. In another preferred embodiment, the pallets are fixed to the bottom support of the frame.

In yet another preferred embodiment, the device further comprises a cover. The cover comprises a base and flaps, wherein the base is at least partially disposed between the frame and the pallet and the flaps protrude out from the frame and the pallet. In one embodiment, the flaps each have two ends and notches at each of the two ends.

In still another embodiment, the sleeve is slidably disposed around the frame. In one embodiment, the sleeve is supported on top of the cover and the pallets are exposed. In another embodiment, the flaps are folded downwardly along horizontal axes on the cover to conceal the pallet from plain view. The horizontal axis of each flap is at a spaced position from the location at which the sleeve is supported on top of the cover, and the sleeve remains supported on top of the cover when the flaps are folded downwardly. Adjacent notches on the ends of adjacent flaps mate to maintain the flaps in a downwardly folded position.

In accordance with another aspect of the present invention, a device for the storage, shipment and display of merchandise is provided. The device comprises a frame comprising a top surface and a cavity beneath the top surface. A storage bin is disposed in the cavity of the frame. The device also comprises walls surrounding at least a portion of the cavity and extending above the top surface of the frame. Merchandise is disposed on the top surface of the frame and in the storage bin.

In a preferred embodiment, the device further comprises a lid to cover the merchandise disposed on the top surface of the frame. The lid preferably comprises apertures to permit air flow through the lid.

In another preferred embodiment, the walls further comprise an opening to permit the removal of the storage bins from the cavity of the frame. In accordance with one preferred embodiment, the walls further comprise a door covering the opening.

In yet another preferred embodiment, the walls are fixed to the frame. In one preferred embodiment, one or more pallets are disposed under the frame.

In still another preferred embodiment, the device further comprises a cover. The cover comprises a base and flaps, wherein the base is at least partially disposed between the frame and the pallet and the flaps protrude outwardly from between the frame and the pallet. In one preferred embodiment, the flaps are folded downwardly along horizontal axes located on the cover to conceal the pallet from plain view. In another preferred embodiment, the flaps each further comprise two ends and a notch at each end. Adjacent flaps are connected together by mating the notches on adjacent flaps.

In accordance with a further aspect of the present invention, a device for the storage, shipment and display of merchandise is provided. The device comprises a display bin containing merchandise, the display bin having an open top end, side walls, and a bottom wall. The device also comprises a frame supporting the display bin, the frame having a top, a bottom, and side structures connecting the top and bottom structures. The frame top, bottom and side structures define a cavity within the support frame and at least one storage bin is disposed in the cavity of the support frame. An outer sleeve configured to be slidably disposed around the storage bins and at least a portion of the support frame is also provided.

In a preferred embodiment, the device further comprises a lid to cover the merchandise in the display bin and the lid preferably comprises apertures to permit air flow through the lid.

In another preferred embodiment, the device further comprises one or more pallets to permit transporting the device. In this preferred embodiment, the pallets are formed in the bottom support of the frame. A skirt is provided to wrap around the pallets and conceal the pallets from plain view.

In accordance with yet another aspect of the present invention, a method for assembling a device containing merchandise for shipping is provided. The method comprises the steps of providing a display bin, a frame comprising a top surface and a cavity, at least one storage bin, a sleeve, and a lid. The display bin is placed on the top surface of the frame and the display bin and storage bins are filled with merchandise. The storage bin is then placed in the cavity of the frame and at least a portion of the frame is covered with the sleeve. The merchandise in the display bin is then covered by the lid.

In one preferred embodiment, the method further comprising providing one or more pallets under the frame to permit transporting the device.

In another preferred embodiment, the method further comprises providing a cover, the cover comprising a base and flaps, wherein the base is at least partially disposed between the frame and the pallet and the flaps protrude outwardly from between the frame and the pallet.

In yet another preferred embodiment, the method further comprising providing a opening in the sleeve to expose the pallets.

In accordance with still a further aspect of the present invention, a method for assembling a device containing merchandise for display at a point-of-sale location is provided. The method comprises providing the assembled device containing merchandise, removing the lid, lifting the sleeve upwardly from the device to expose the at least one storage bins, removing the at least one storage bin containing merchandise from the frame cavity, returning the sleeve to its original position to cover at least a portion of the frame, and transferring the merchandise from the at least one storage bin to the display bin.

In one preferred embodiment, the method further comprises folding the flaps downwardly to conceal the pallets. In another preferred embodiment, the method further comprises securing the flaps in the downwardly folded position.

In accordance with yet a further aspect of the present invention, a device for the storage, shipment and display of merchandise is provided. The device comprises display means for storing and displaying merchandise, storage means for storing additional merchandise for the display means, frame means for supporting the display means and the storage means, and sleeve means for concealing at least a portion of the frame the storage means from plain view.

In one preferred embodiment, the device further comprises a transport means to enable the transport of the device. In another preferred embodiment, the device further comprises panel means to cover the exposed transport means after the device is transported to a desired point-of-sale location.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
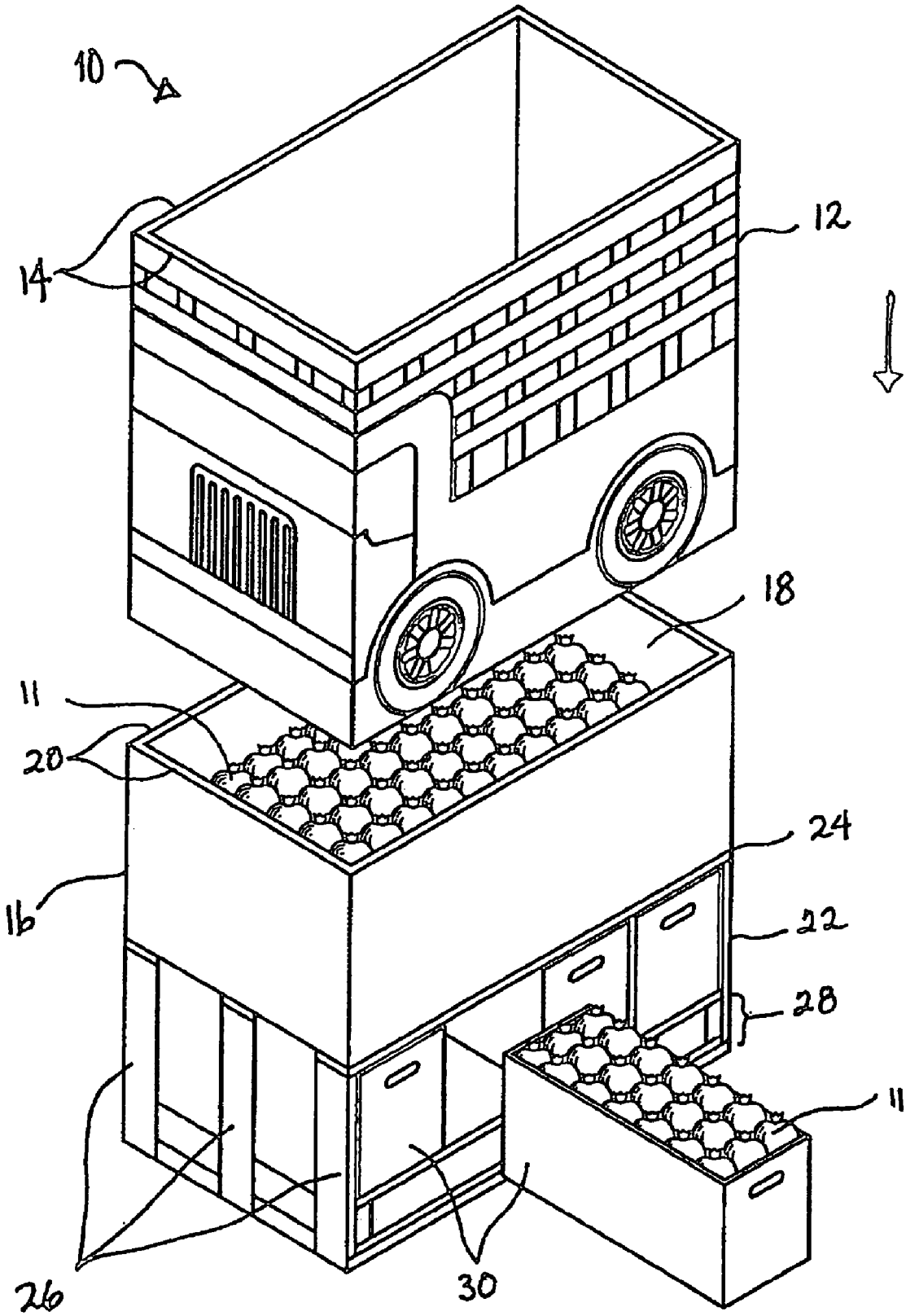
FIG. 1 is an exploded perspective view of an embodiment of the transportable merchandise display device.
Figure 2:
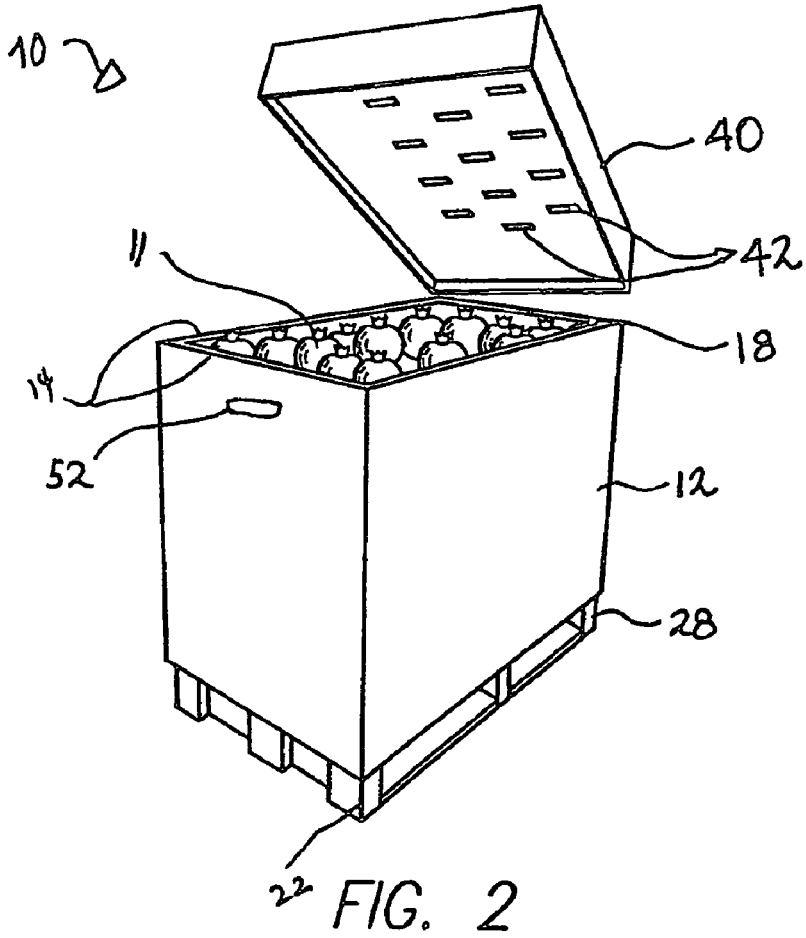
FIG. 2 is a perspective view of the device in FIG. 1 with the sleeve configured for shipment.
Figure 3:
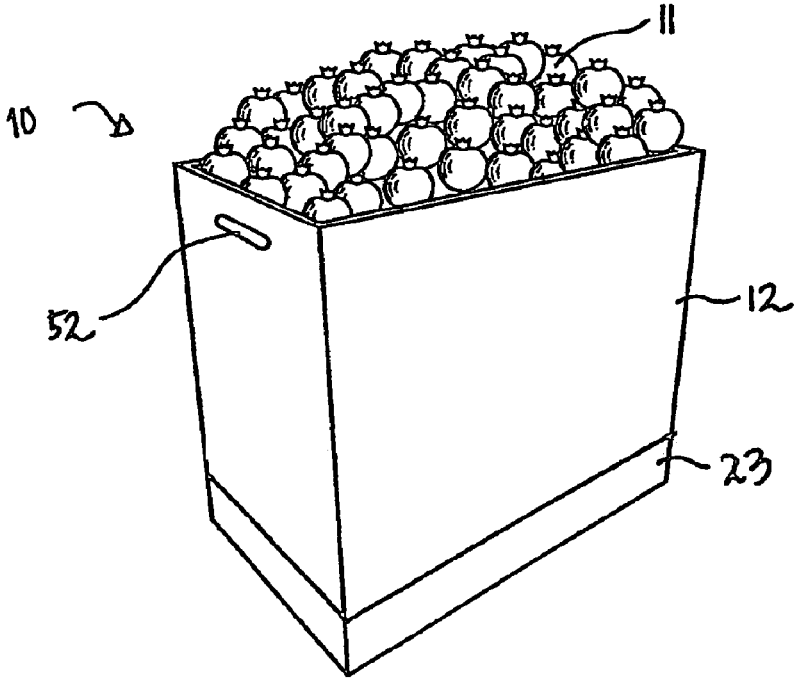
FIG. 3 is a perspective view of the device in FIG. 1 with the panels folded downwardly from the sleeve for display.

Referring to FIGS. 1-3, a merchandise storage, shipment and display device (10) in accordance with a preferred embodiment of the present invention is described. The device (10) preferably comprises a display bin (16) and a frame (22) disposed under the display bin (16). The frame (22) comprises a top support (24), a bottom support (28), and side supports (26) connecting the top (24) and bottom supports (28). Storage bins (30) are removably disposed in the cavity of the frame (22) between the top (24) and bottom supports (28) and a sleeve (12) comprising a pair of opposing walls (14) is disposed around at least a portion of the frame (22). Both the display (16) and storage bins (30) contain merchandise (11) intended for sale at a retail or other point-of-sale location.

The sleeve (12) depicted in FIG. 1 comprises a pair of opposing walls (14) and is configured to be slidably disposed around at least a portion of the frame (22). The sleeve (12) is lifted above the frame (22) to permit removal of the storage bins (30) from the cavity of the frame (22). Optionally, and as shown in FIG. 1, the outer surface of the sleeve (12) may also include artistic designs or marketing and promotional advertisement of the merchandise (11) contained in the display bin (16).

The display bin (16) contains merchandise (11) that is displayed at the point-of-sale location. The display bin (16) is disposed on the top support (24), and preferably, the display bin (16) is fixed to the top support (24) by staples, nails, permanent or semi-permanent adhesives, and by any other means known to one of skill in the art.

The storage bins (30) each contain additional merchandise (11) to replenish the depleting supply of merchandise (11) in the display bin (16). The storage bins (30) depicted in FIG. 1 are slidably and removably disposed in the cavity of the frame (22).

The display bin (16) in FIG. 1 comprises a bottom (not shown), vertical side walls (20), and an open top end (18). Typically, merchandise (11) contained in the display bin (16) is displayed for sale at the retail or other point-of-sale location, while the merchandise (11) contained in the storage bins (30) is concealed from plain view by the sleeve (12).

In FIGS. 1-3, the combined height of the display bin (16) and of the frame (22) is selected to provide ease of reach for the merchandise in the display bin (16) for the average consumer. In one preferred embodiment, the combined height of the display bin side walls (20) and support frame (22) is about 30 to 40 inches, preferably about 32 to 38 inches, and optimally about 34 to 36 inches.

The height of the display bin side walls (20) depends on the height of the frame (22), i.e. the height at which the display bin (16) is elevated above the ground by the frame (22). Accordingly, the height of the display bin side walls (20) is preferably selected with reference to the height of the frame (22) and vice versa. In one preferred embodiment, the height of the display bin is about 15 to 20 inches, preferably about 16 to 19 inches, and optimally about 17 to 18 inches. In accordance with this preferred embodiment, the height of the frame (22) is about 15 to 20 inches, preferably about 16 to 19 inches, and optimally about 17 to 18 inches.

Side supports (26) of the frame (22) connect the frame top support (24) and the bottom support (28). Again, the height of the side supports (26) is determined with reference to the desired height for the frame (22) which, in turn, depends on the desired height of the display bin side walls (20). In a preferred embodiment, the frame bottom support (28) is configured to enable the transport of the device (10) from one location to another. In one preferred embodiment, the frame bottom support (28) may be configured as a pallet to permit transport of the device (10) by a forklift. In other preferred embodiments, the frame bottom support (28) is configured to be placed on top of a separate pallet.

The length and width of the display device (10) is selected with reference to optimizing the number of display devices (10) that may be provided in a single shipment. For example, a standard pallet in the produce industry typically has a width of about 40 inches and a length of about 48 inches. Accordingly, in a preferred embodiment, a single display device (10) has a width of about 24 inches and a length of about 40 inches, such that two display devices (10) containing merchandise (11) can be placed on top of a single standard size pallet. Additional standard sized pallets having two display devices (10) can be stacked on top to provide, for example, up to four display devices (10) within a single standard size pallet area of 48×40 inches.

Accordingly, in preferred embodiments, the bottom support (28) of the frame (22) is a half-pallet that measures about 40 inches in length and 24 inches in width. In alternate preferred embodiments, the bottom support (28) is configured to be placed on top of a half-pallet that is separately provided.

As shown in FIG. 2, the device (10) preferably includes a lid (40) to cover the merchandise in the display bin (16). The lid (40) may be fitted over both the open top end (18) of the display bin (16) and the sleeve walls (14). In the preferred embodiment shown in FIG. 2, the lid (40) comprises apertures (42) to permit air flow through the lid. Although not shown in the Figures, in another preferred embodiment, the bottom wall of the display bin (16) may also comprise apertures to permit air flow through the bottom of the display bin (16)

Referring to FIGS. 2-3, an embodiment of the display device (10) is shown in which the bottom support (28) of the frame (22) is configured as a pallet to enable transport. In this embodiment, the pallet is integral with the frame. The sleeve (12) is shown as positioned in a manner relative to the frame (22) to keep the bottom support (28) exposed during storage and shipment. The exposed bottom support (28) can then be manipulated by a fork lift or other machinery to transport the device (10) to a desired location during shipment.

In one embodiment, the sleeve (12) is maintained in an elevated position above the bottom support (28) of the frame (22) by fixing the sleeve (12) to the display bin (16), the frame (22), or both. The sleeve (12) may be fixed to the display bin (16) in any manner known to one of ordinary skill in the art such as, for example, by staple, fasteners, clips, nails, glues, and adhesives. In another embodiment, the sleeve (12) is maintained by projections or stoppers, such as pegs or nails, placed on the frame (22) above the pallet bottom support (28) and beneath the bottom of the sleeve (12).

In another preferred embodiment, depicted in FIGS. 2-3, one or more tab handles (52) may be disposed on the sleeve wall (14). The tab handles (52) are formed by cutting a flap on the sleeve wall (14) and by cutting a corresponding opening in the side walls (20) of the display bin (16). The sleeve (12) is maintained in an elevated position above the bottom support (28) by inserting the flap attached to the sleeve wall (14) through the corresponding opening in the side walls (20) of the display bin (16).

Once the display device reaches its intended point-of-sale or retail location, the bottom support (28) of the frame (22) may be concealed. As shown in FIG. 3, the bottom support (28) of the frame (22) covered by a skirt (23) around the bottom support (28). In one embodiment, the skirt (23) is a separate structure that is made of any suitable material, such as cloth, fabric, or piece of corrugated cardboard, that is wrapped around at least a portion of the bottom support (28) of the frame (22). In another embodiment, the skirt (23) is a part of the sleeve (12) that is folded up during storage and shipment and folded down over the bottom support (28) of the frame (22).

In other preferred embodiments, the frame bottom support is configured to be placed on top of a separate pallet.

FIGS. 4-7 show other preferred embodiments of the display device. In these preferred embodiment, the display device (100) comprises a display bin (160), a frame (220) disposed under the display bin (160), and a sleeve (120) disposed around at least a part of the frame (220). The frame (220) comprises a top support (240) coupled to a bottom support (280) and a cavity defined between the top (240) and bottom supports (280). Storage bins (300) are disposed in the cavity of the frame (220) and a sleeve (120) comprising walls (140) is disposed around at least a portion of the frame (220). Both the display bin (160) and storage bins (300) contain merchandise (110) intended for sale at a retail or other point-of-sale location.

Figure 4:
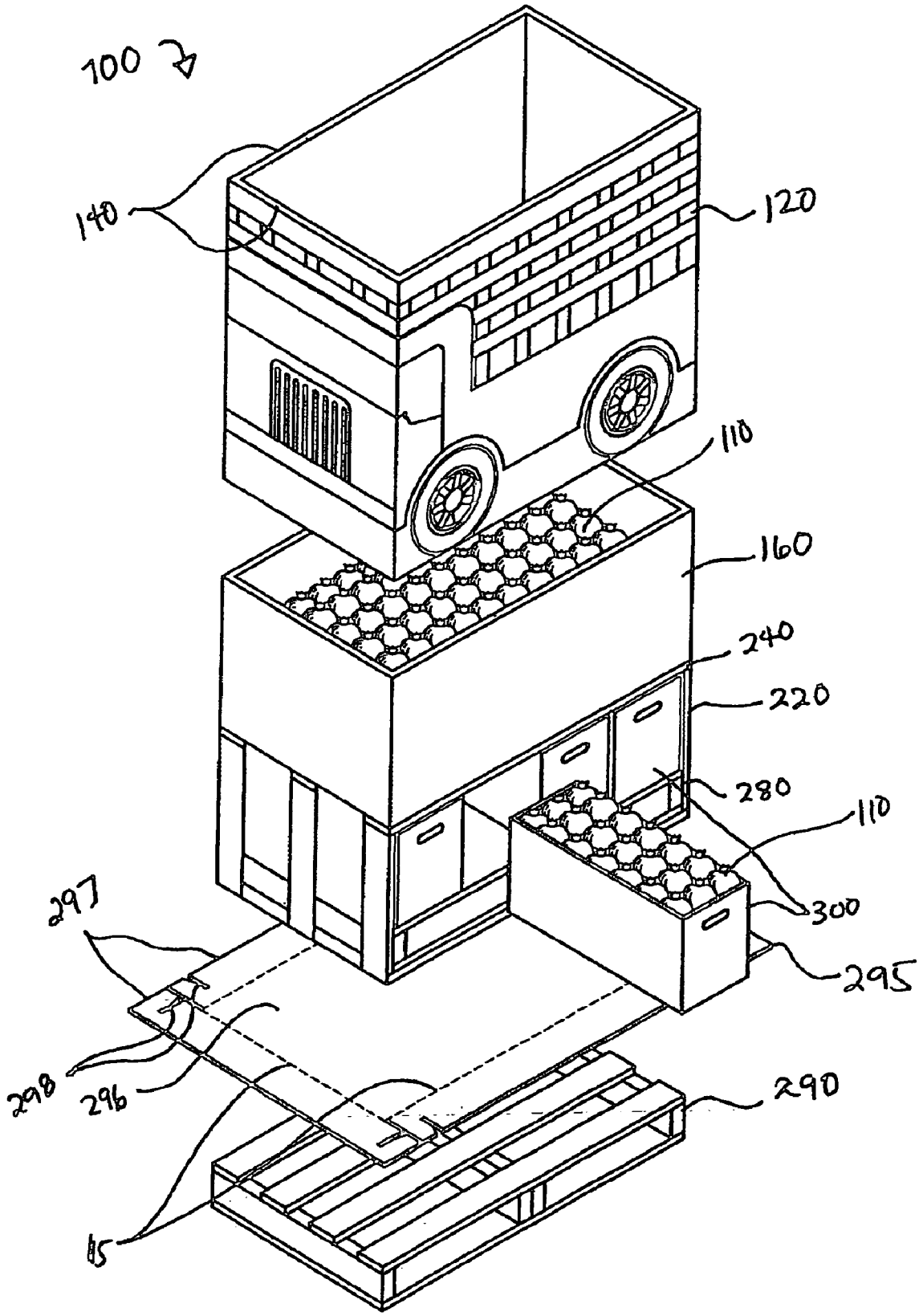
FIG. 4 is an exploded perspective view of another embodiment of the transportable merchandise display device.
Figure 5:
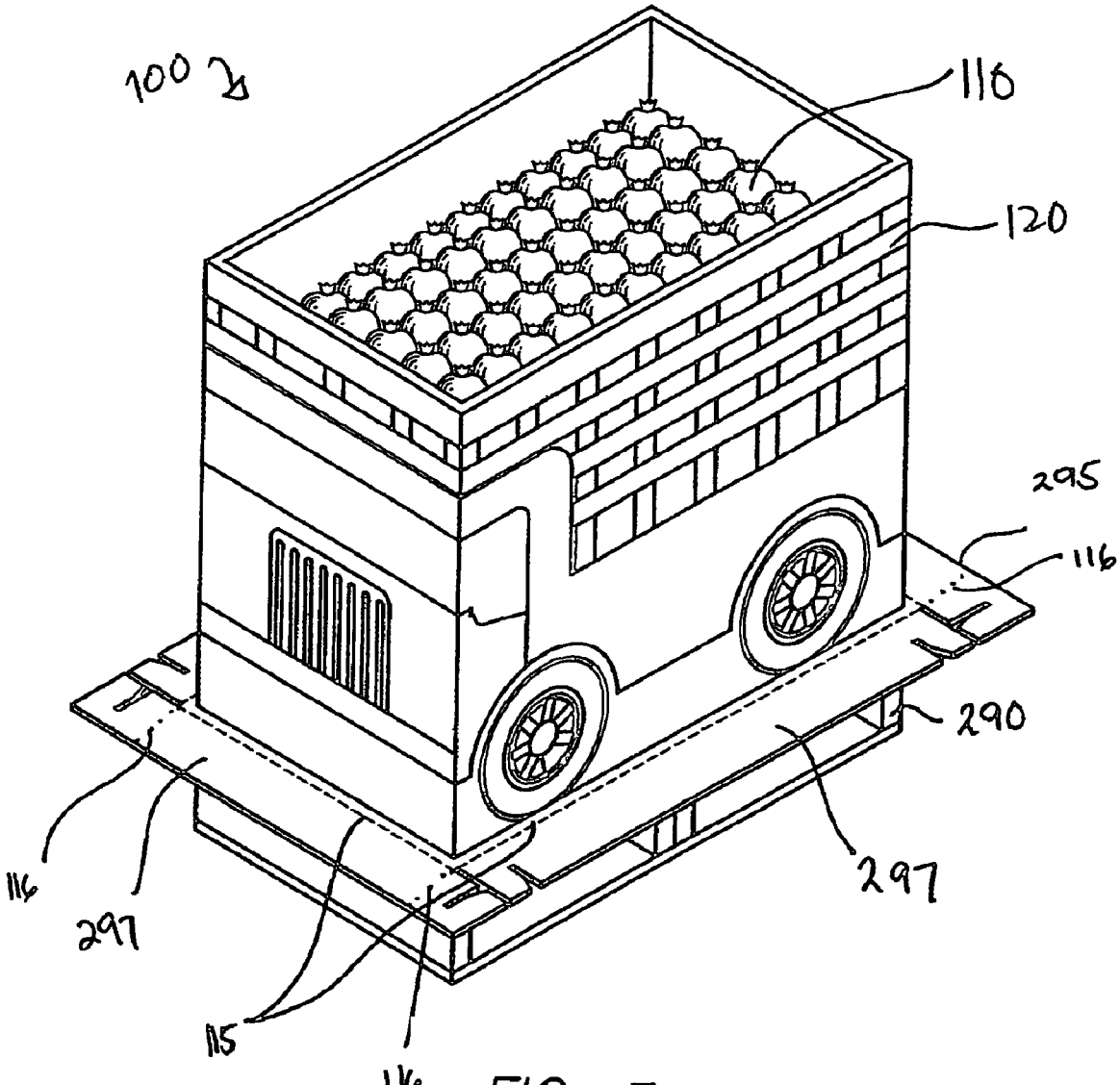
FIG. 5 is a perspective view of the device in FIG. 4 assembled for shipment.
Figure 6:
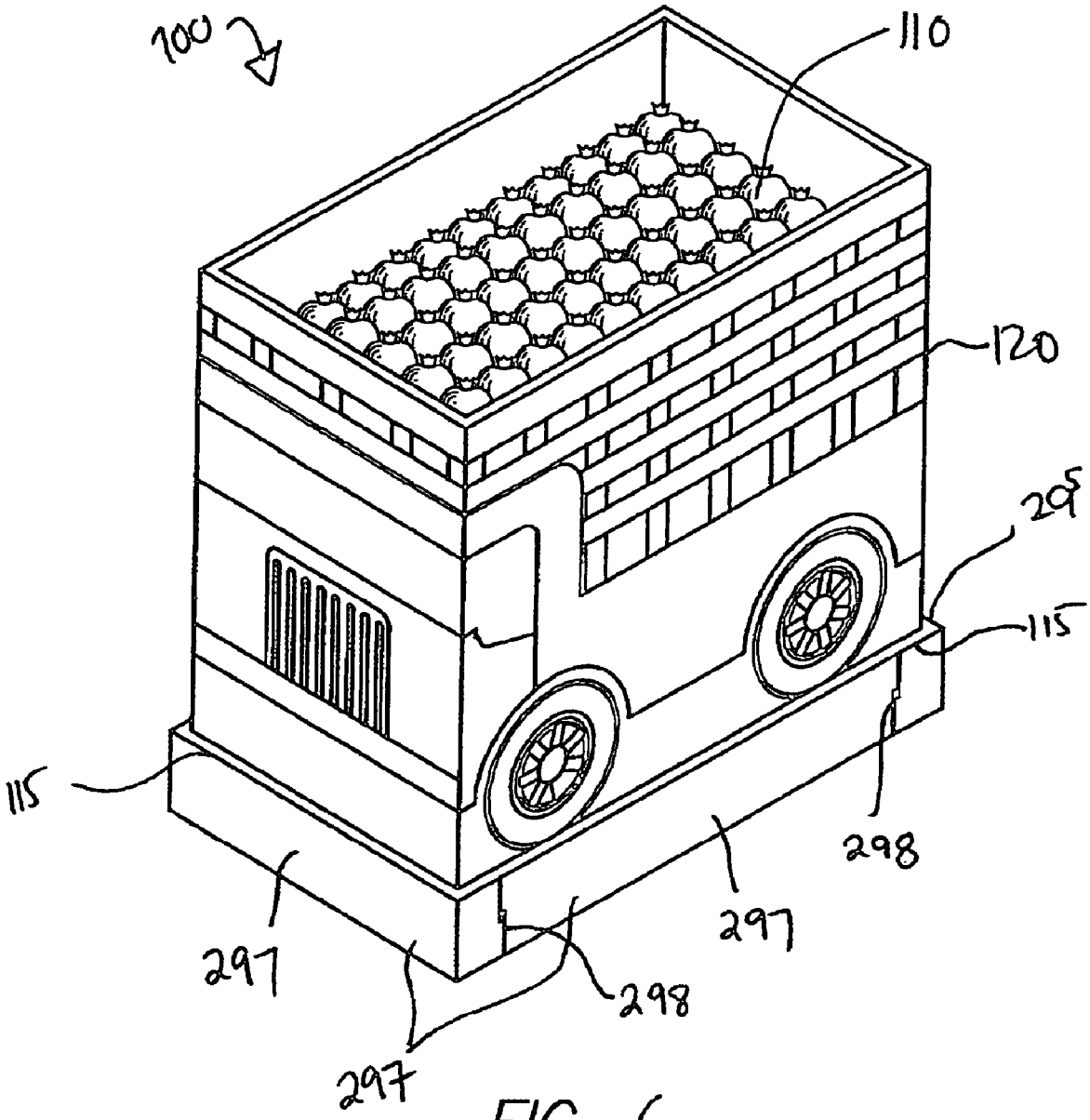
FIG. 6 is a perspective view of the device in FIG. 4 assembled for display at a point-of-sale location.

In a preferred embodiment, as shown in FIGS. 4-6, a separate pallet (290) is disposed under the bottom support (280) of the frame (220). A cover (295) comprising a base (296) and flaps (297) is disposed between the bottom support (280) and the pallet (290). The base (296) is at least partially disposed between the frame bottom support (280) and the pallet (290). The flaps (297) protrude out from under the frame (220) and over the pallet (290). The cover (295) each further comprises horizontal axes (115) along which the flaps (297) may be folded down to conceal the pallet (290). In addition, the flaps (297) each comprises two ends and a notch (298) on each of the two end. After the flaps (297) are folded along the horizontal axes (115), the flaps (297) are further folded along the vertical axes (116) and the notches (298) on adjacent flaps (297) are mated together to maintain the flaps (298) in a downwardly folded position. Although FIGS. 4-6 depict the use of notches, this is only a preferred embodiment. Other means and methods to maintain the flaps (297) in a downwardly folded position are contemplated, such as by tape, staples, adhesives, etc.

In a preferred embodiment, the sleeve (120) is slidably disposed around the frame (220). As shown in FIG. 5, the sleeve (120) is supported on top of the cover (295) and is prevented from sliding down over the pallet (290). This ensures that the pallet (290) is accessible during transportation of the device (100) by a forklift or, other mechanical device.

Figure 7:
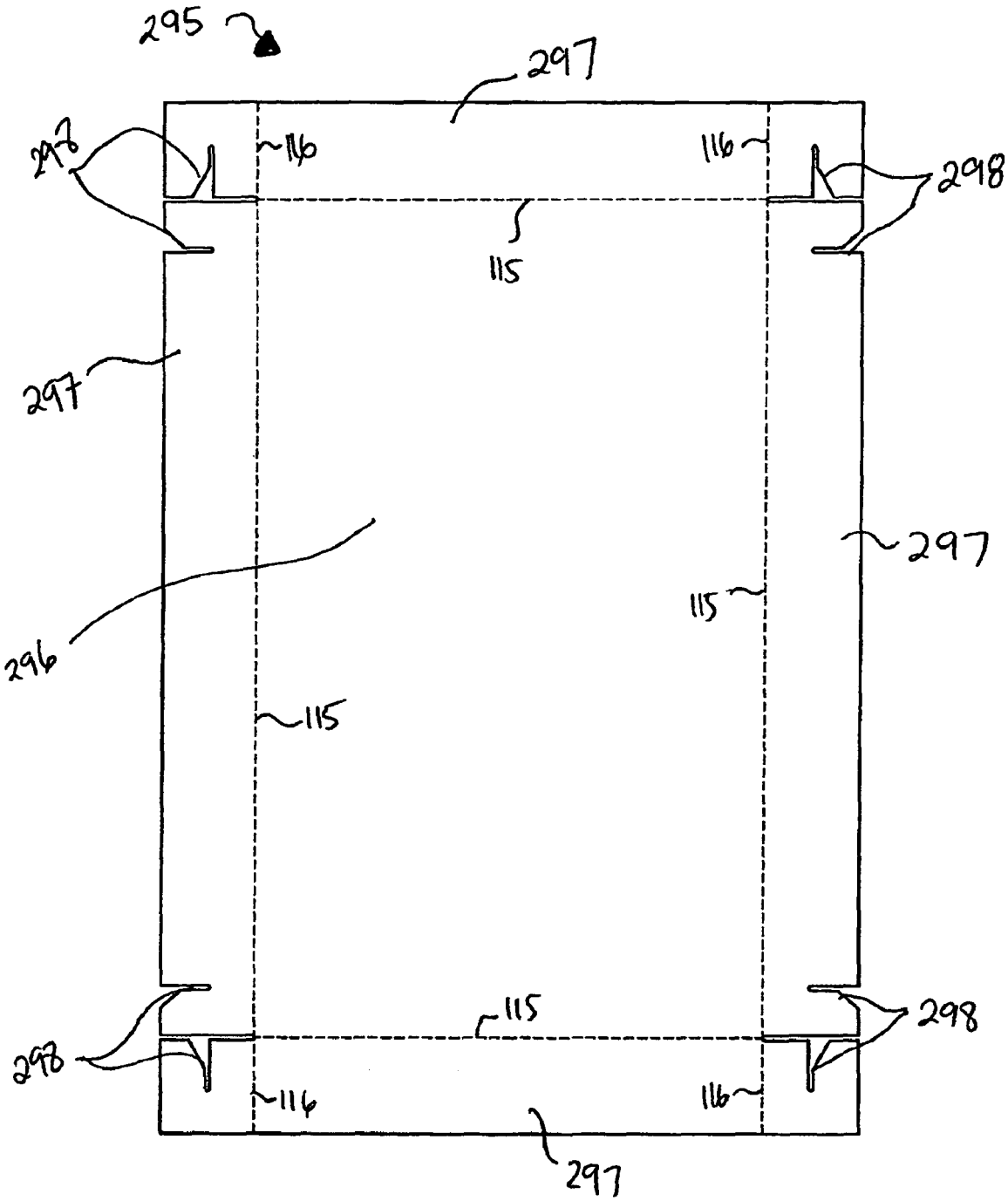
FIG. 7 is a top view of the cover depicted in FIGS. 4-6.

FIG. 7 shows a front view of the cover (295) depicted in FIGS. 5-6. The cover (295) comprises a base (296) and four flaps (297). The flaps (297) each further comprise two ends and notches (298) on the two ends. Adjacent notches (298) of adjacent flaps (297) are intended to mate and connect together when the flaps (297) are folded downwardly to cover the pallet (290). Each of the four flaps (297) are folded along the horizontal axes (115) defined by the dotted lines. After the four flaps (297) are folded along the horizontal axes (115), the two of the flaps (297) are further folded along a vertical axes (116) and the adjacent notches (298) are urged and mated together.

Accordingly, with reference to FIG. 6, the flaps (297) are folded downwardly to conceal the pallet (290) (not shown) from plain view. The horizontal axes (115) of each flap (297) is located in spaced relation from the sleeve (120). The sleeve (120) is supported on top of the cover (295) and the flaps (297) are folded downwardly to conceal the pallet (290).

FIGS. 8A-8F show the steps involved in assembling one preferred embodiment of the transportable merchandise display device (100) of FIG. 4 at the intended point-of-sale location for displaying the merchandise.

Figure 8A:
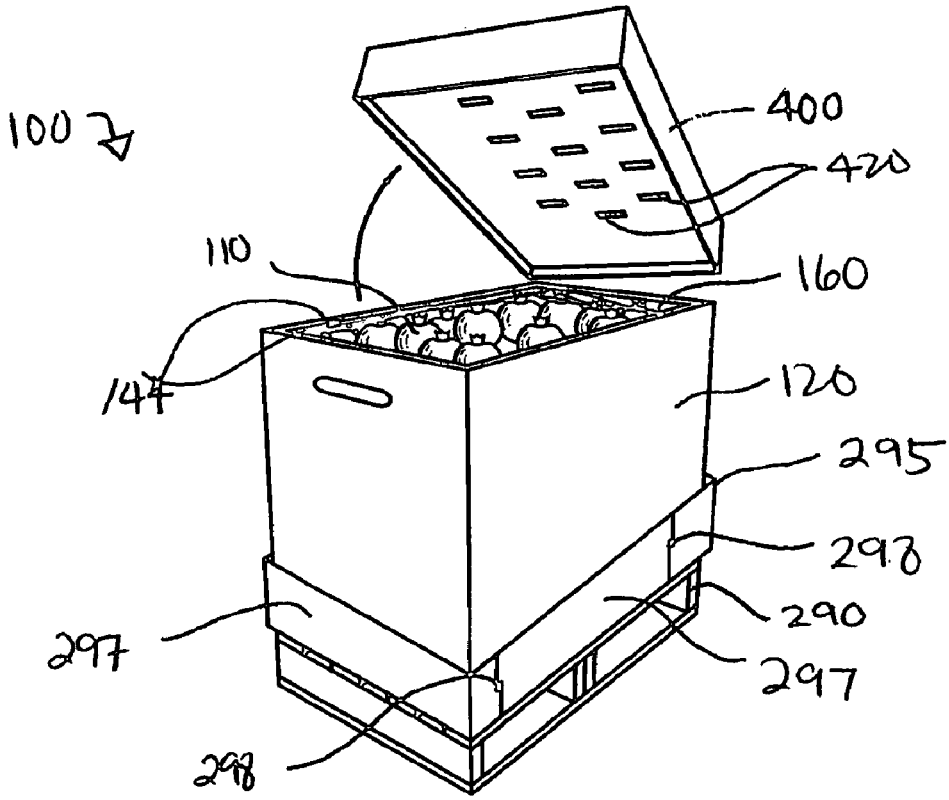
FIG. 8A-F show the steps involved in assembling the transportable merchandise display device in FIG. 4 for display.

As shown in FIG. 8A, the lid (400) is removed from the device (100) to expose the merchandise (110) contained in the display bin (160). The cover (295) disposed between the bottom support (280) of the frame (220) and the pallet (290) prevents the sleeve (120) from sliding over the pallet (290) and covering the pallet (290). As shown in FIG. 8A, the flaps (297) of the cover (295) are upwardly folded along the horizontal axes (115) to completely expose the pallet (290). The notches (298) at the ends of adjacent flaps (297) are mated together to maintain the flap in an upwardly folded position for storage and shipment. Although FIG. 8A depicts the use of notches (298) to keep the flaps (297) in an upwardly folded position, other methods may be used to maintain the flaps (297) in an upwardly folded position, such as nails, staples, glue, adhesive, and other methods known to one of skill in the art. Maintaining the flaps (297) in the upwardly folded position as shown in FIG. 8A permits multiple display devices (100) to be placed adjacent to one another in close proximity.

Figure 8B:
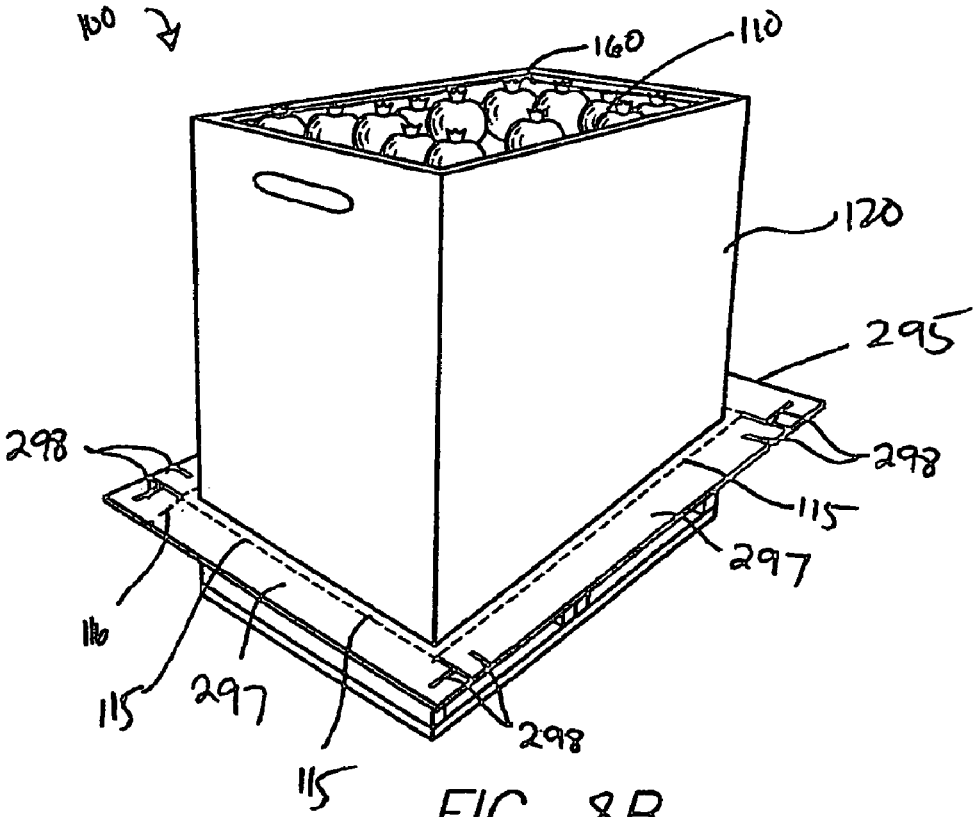
Figure 8C:
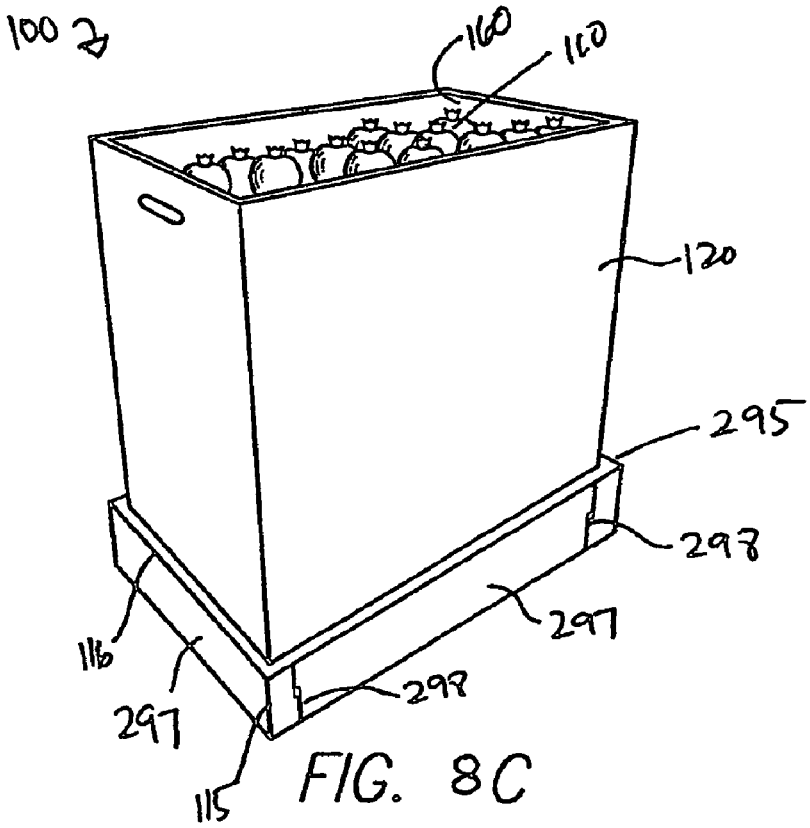

Once the device reaches its intended point-of-sale or retail location, the device may be prepared for display. In FIG. 8B, the notches (298) coupling adjacent flaps (297) are disengaged and the flaps (297) are separate from one another. Then, as shown in FIG. 8C, the flaps (297) are folded downwardly along the horizontal axes (115) and again along the vertical axes (116) to engage adjacent notches (298) together to conceal the pallet (290) and thereby enhance the appearance of the device (100) as a display for the merchandise. Although FIG. 8C depicts the use of notches (298) to keep the flaps (297) in a downwardly folded position, other methods may be used to maintain the flaps (297) in a downwardly folded position, such as nails, staples, glue, adhesive, and other methods known to one of skill in the art.

Figure 8D:
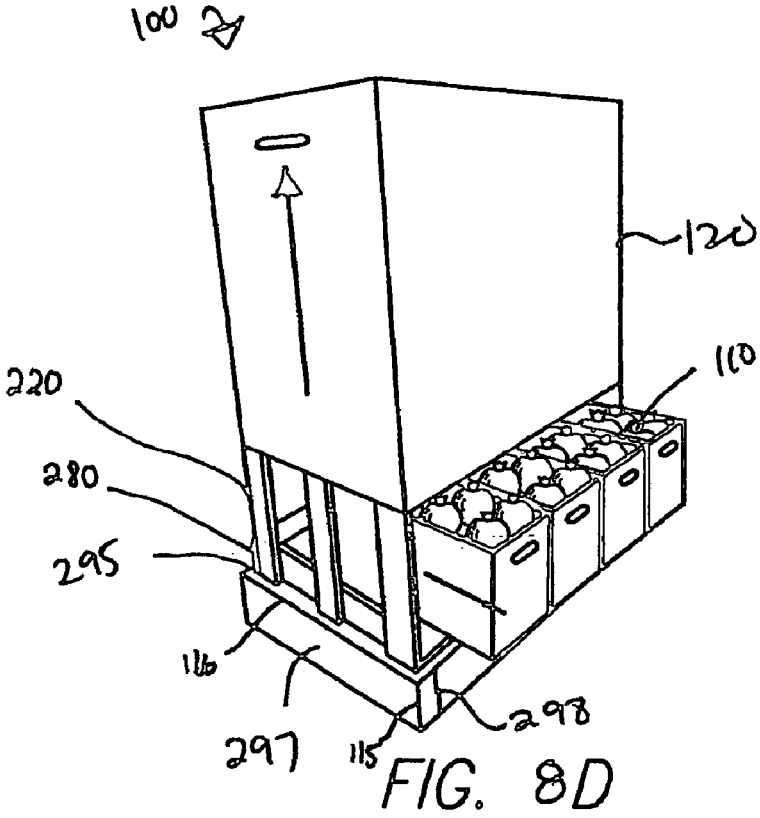
Figure 8E:
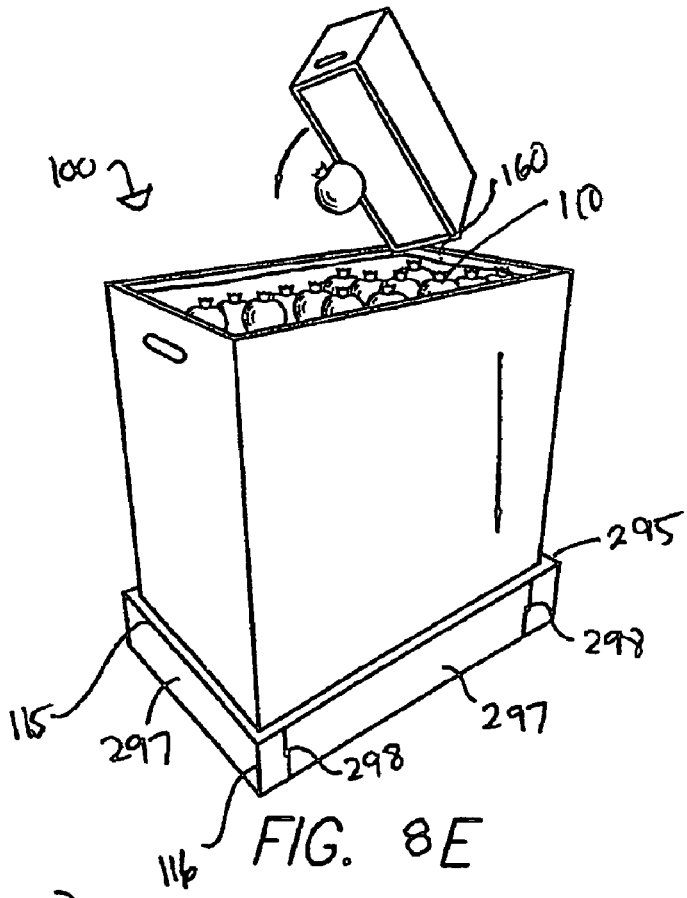
Figure 8F:
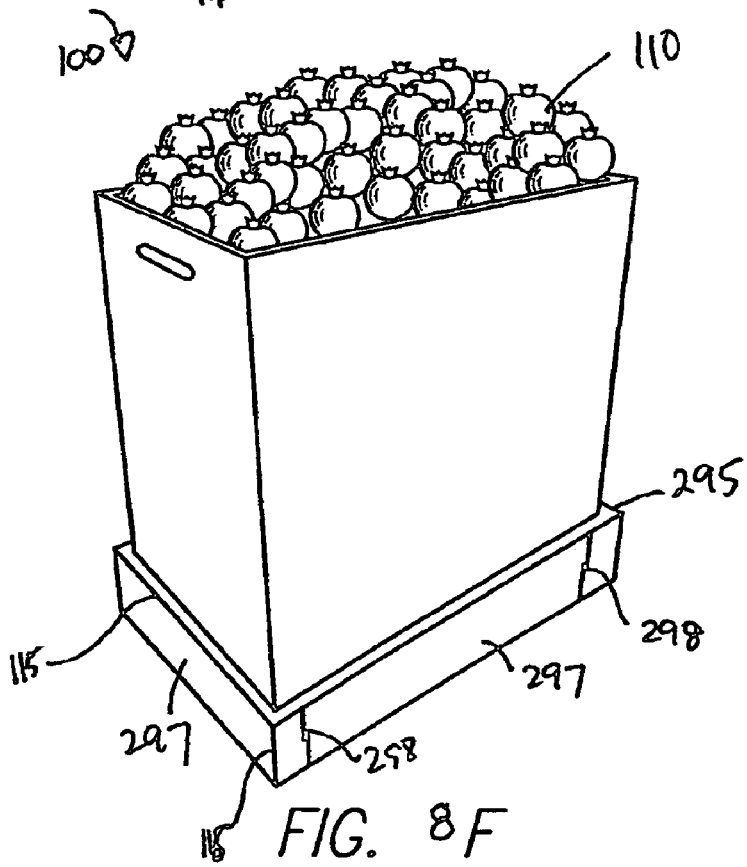

In FIG. 8D, the sleeve (120) is lifted in an upwardly direction, as indicated by the arrow, to access and remove the storage bins (300) containing additional merchandise (110) disposed from the cavity of the frame (220). Once the storage bins (300) are removed from the cavity of the frame (220), the sleeve (120) is returned to its original position by replacing the sleeve (120) down on top of the cover (295). As shown in FIG. 8E, merchandise (110) contained in the storage bins (300) is transferred to the display bin (160). FIG. 8F shows the fully-assembled display device.

In yet other preferred embodiments not shown in the Figures, the display device comprises a frame having a top surface and a cavity beneath the top surface, walls surrounding at least a portion of the cavity and extending above the top surface of the frame and one or more storage bins disposed in the cavity of the frame. In these preferred embodiments, the walls are fixed to the frame and extend above the top surface of the frame to contain merchandise disposed on the top surface of the frame. In one preferred embodiment, the walls further comprise an opening beneath the top surface of the frame to permit the removal of the storage bins from the cavity of the frame. In another preferred embodiment, the walls further comprise a door covering the opening. In one preferred embodiment, the door may be hingedly attached to the walls to cover the opening. In another preferred embodiment, the door may be a part of the wall that is cut out of the walls but remains attached to the wall at one end.

It is understood the devices disclosed and described herein is not limited to the storage, shipment and display of any particular merchandise. Rather, the assemblies may be used to ship, store and display a variety of merchandise and consumer goods.

The invention described and claimed herein is not to be limited in scope by the specific preferred embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

The invention claimed is:

1. A device for the storage, shipment and display of merchandise, the device comprising:

a display bin;

a frame disposed under the display bin, the frame comprising a top support coupled to a bottom support and a cavity between the top and bottom supports, wherein the bottom support is configured as a pallet having a top layer and a bottom layer that cooperate to define a space therebetween;

at least two removable storage bins disposed in the cavity of the frame and on the top layer of the pallet; and a removable sleeve comprising four walls slidably disposed around the frame and concealing the removable storage bins; a lid to cover the merchandise in the display bin.

2. The device of claim 1, wherein the removable sleeve includes a foldable skirt at the bottom thereof that is adapted to be folded down over the bottom support of the frame.

3. The device of claim 1, wherein the lid comprises apertures to permit air flow through the lid.

4. The device of claim 1 further comprising one or more pallets disposed under the frame.

5. The device of claim 4 further comprising a cover, the cover comprising a base and flaps, wherein the base is at least partially disposed between the frame and the pallet and the flaps protrude out from the frame and the pallet.

6. The device of claim 5, wherein the sleeve is supported on top of the cover and wherein the pallets are exposed.

7. The device of claim 6, wherein the flaps are folded downwardly along a horizontal axis on the cover to conceal the pallet from plain view.

8. The device of claim 7, wherein the flaps each further comprise two ends and notches at the ends of the flaps, wherein adjacent notches on the ends of adjacent flaps mate to maintain the flaps in a downwardly folded position.

9. The device of claim 8, wherein the horizontal axis of each flap is at a spaced position from the location at which the sleeve is supported on top of the cover, wherein the sleeve remains supported on top of the cover when the flaps are folded downwardly.

10. A device for the storage, shipment and display of merchandise, the device comprising:

a frame comprising a top support coupled to a bottom support by side supports and a cavity between the top and bottom supports, wherein the bottom support is configured as a pallet having a top layer and a bottom layer that cooperate to define a space therebetween, and wherein the side supports extend to the bottom layer of the pallet;

walls surrounding at least a portion of the cavity and extending above the top support of the frame; and at least two storage bins removably disposed in the cavity of the frame, whereby the storage bins and merchandise therein can be removed from the cavity; wherein merchandise is disposed on the top surface of the frame and in the storage bin, and wherein the walls form a sleeve that is adapted to be slidably removed from the frame, wherein the sleeve includes a foldable skirt that is adapted to be folded down over the bottom support of the frame.

11. The device of claim 10 further comprising a lid to cover the merchandise disposed on the top surface of the frame.

12. The device of claim 11, wherein the lid comprises apertures to permit air flow through the lid.

13. The device of claim 10, wherein the sleeve hides the storage bins from plain view.

14. The device of claim 13, wherein the storage bins have handle holes defined therein.

15. The device of claim 10, wherein the walls are fixed to the frame.

16. The device of claim 10 further comprising one or more pallets disposed under the frame.

17. The device of claim 16 further comprising a cover, the cover comprising a base and flaps, wherein the base is at least partially disposed between the frame and the pallet and the flaps protrude outwardly from between the frame and the pallet.

18. The device of claim 17, wherein the flaps are folded downwardly along a horizontal axis located on the cover to conceal the pallet from plain view.

19. The device of claim 18, the flaps each further comprising two ends and notches at the ends of the flaps, wherein adjacent flaps are connected together by mating the notches on adjacent flaps.

20. A device for the storage, shipment and display of merchandise, the device comprising:

a display bin containing merchandise, the display bin having an open top end, side walls, and a bottom wall;

a frame supporting the display bin, the frame having a top, a bottom, and side structures connecting the top and bottom structures, wherein the top, bottom and side structures define a cavity within the support frame, wherein the cavity includes a front opening and a rear opening, and wherein the bottom structure is configured as a pallet having a top layer and a bottom layer that cooperate to define a space therebetween;

at least one removable storage bin disposed in the cavity of the support frame, wherein the storage bin is removable through the front opening or the back opening; and a removable outer sleeve configured to be slidably disposed around the support frame, such that it can be raised and lowered to provide access to the at least one removable storage bins; a lid to cover the merchandise in the display bin.

21. The device of claim 20, wherein the lid comprises apertures to permit air flow through the lid.

22. The device of claim 20 further comprising one or more pallets disposed under the bottom structure to permit transporting the device.

23. The device of claim 22 further comprising a skirt configured to wrap around the pallets and conceal the pallets from plain view.

24. The device of claim 20, wherein the removable sleeve includes a foldable skirt that is adapted to be folded down over the bottom support of the frame.

* * * * *